US005646361A

United States Patent [19]

Morrow

[11] Patent Number: 5,646,361

[45] Date of Patent: Jul. 8, 1997

[54] LASER EMITTING VISUAL DISPLAY FOR A MUSIC SYSTEM

[76] Inventor: Michael Morrow, 985 S. Monterosa Dr., Pueblo West, Colo. 81007

[21] Appl. No.: 511,279

[22] Filed: Aug. 4, 1995

[51] Int. Cl.[6] ..... A63J 17/00

[52] U.S. Cl. ..... 84/464 R; 362/249; 362/259

[58] Field of Search ..... 84/464 R, 477 R; 362/259, 249, 231, 811

[56] References Cited

U.S. PATENT DOCUMENTS

| | | | |
|---|---|---|---|
| 4,006,970 | 2/1977 | Slater et al. | 350/285 |
| 4,887,197 | 12/1989 | Effinger | 362/306 |
| 4,962,687 | 10/1990 | Belliveau et al. | 84/464 R |

*Primary Examiner*—Michael L. Gellner
*Assistant Examiner*—Shih-yung Hsieh

[57] ABSTRACT

A laser emitting visual display for a music system including a housing with a hollow interior and transparent window. A plurality of lasers are coupled within the housing and disposed to emit high intensity light beams generally towards the transparent window when actuated. Also included is a control mechanism situated within the housing and coupled to a current source, an output of a music system, and each of the lasers. The mechanism is adapted to actuate different lasers depending on the frequency and volume of a signal received via the output of the music system thereby effecting a coincident visual and audio spectacle.

5 Claims, 3 Drawing Sheets

LASER EMITTING VISUAL DISPLAY FOR A MUSIC SYSTEM

BACKGROUND OF THE INVENTION

1. Field of the Invention

The present invention relates to a new and improved laser emitting visual device for a music system and, more particularly, pertains to a visual device working in conjunction with a music system to effect a coincident visual and audio spectacle.

2. Description of the Prior Art

The use of music responsive lighting devices is known in the prior art. More specifically, music responsive devices heretofore devised and utilized for the purpose of controlling light through the use of music are known to consist basically of familiar, expected, and obvious structural configurations, notwithstanding the myriad of designs encompassed by the crowded prior art which has been developed for the fulfillment of countless objectives and requirements.

The prior art discloses a large number of music responsive lighting devices. By way of example, U.S. Pat. No. 5,149,317 to Robinson discloses a musically responsive lighting system which incorporates a unique display glasses arrangement. U.S. Pat. No. 5,121,435 to Chen discloses an acoustic control circuit for sequencing the flashing of Christmas lights according to the rhythm and volume of ambient sound. Finally, U.S. Pat. No. 3,603,195 to Williams discloses a music-responsive light display formed by a series of mirrors suspended in front of a speaker.

In this respect, the laser emitting visual device for a music system according to the present invention substantially departs from the conventional concepts and designs of the prior art, and in doing so provides an apparatus primarily developed for the purpose of working in direct conjunction with a music system to effect a coincident visual and audio spectacle.

Therefore, it can be appreciated that there exists a continuing need for a new and improved laser emitting visual device for a music system which can be used for working in direct conjunction with a music system to effect a coincident visual and audio display. In this regard, the present invention substantially fulfills this need.

SUMMARY OF THE INVENTION

In view of the foregoing disadvantages inherent in the known types of music responsive lighting devices now present in the prior art, the present invention provides an improved laser emitting visual device for a music system. As such, the general purpose of the present invention, which will be described subsequently in greater detail, is to provide a new and improved laser emitting visual device for a music system and methods which have all the advantages of the prior art and none of the disadvantages.

To attain this, the present invention essentially comprises a rectangular housing with a hollow interior defined by a horizontal planar top and bottom wall and a periphery formed therebetween consisting of a front wall, rear wall, and pair of side walls. A tinted transparent window is integrated within the front wall. Also included is a hollow tubular laser mount centrally coupled between the interior faces of the opposed side walls comprising a plurality of diametrically opposed apertures. The apertures form a plurality of angles less than 60 degrees with respect to the horizontal. A plurality of multi-color cylindrical lasers are infixed within the apertures and comprise a laser emitting end and power receiving end with the laser emitting end facing in the general direction of the transparent window. The lasers are adapted to emit specific colored high intensity light beams when actuated via the power receiving end. Further included is a control module situated in the rear of the housing and coupled to an alternating current source, an output of a music system, and each of the power receiving ends of the lasers. The control module comprises a plurality of switches coupled between each power receiving end of the lasers and the current source. Each switch has an open orientation for withholding current from the particular laser and a closed orientation for allowing current to flow thereto. The control module is adapted to actuate different switches depending on the frequency and volume of a signal received via the output of the music system. A plurality of mirrors line the interior surfaces of the top and bottom walls and periphery of the housing to enhance the visual effect of the lasers. Finally, an actuator switch is positioned on the front face of the housing and coupled to the control module. The actuator switch has an open orientation for withholding current from the control module and closed orientation for allowing current to flow thereto thereby actuating the laser emitting visual device hence activating different lasers upon receipt of various signals from the output of the music system.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved laser emitting visual device for a music system which has all the advantages of the prior art music responsive lighting devices and none of the disadvantages.

It is another object of the present invention to provide a new and improved laser emitting visual device for a music system which may be easily and efficiently manufactured and marketed.

It is a further object of the present invention to provide a new and improved laser emitting visual device for a music system which is of a durable and reliable construction.

An even further object of the present invention is to provide a new and improved laser emitting visual device for a music system which is susceptible of a low cost of manufacture with regard to both materials and labor, and which accordingly is then susceptible of low prices of sale to the consuming public, thereby making such laser emitting visual device for a music system economically available to the buying public.

Still yet another object of the present invention is to provide a new and improved laser emitting visual device for a music system which provides in the apparatuses and methods of the prior art some of the advantages thereof, while simultaneously overcoming some of the disadvantages normally associated therewith.

Even still another object of the present invention is to provide a laser emitting visual device for a music system working in conjunction with the music system to effect a coincident visual and audio spectacle.

Lastly, it is an object of the present invention to provide a laser emitting visual display for a music system including a housing with a hollow interior and transparent window. A plurality of lasers are coupled within the housing and disposed to emit high intensity light beams generally towards the transparent window when actuated. Also included is a control mechanism situated within the housing and coupled to a current source, an output of a music system, and each of the lasers. The mechanism is adapted to actuate different lasers depending on the frequency and volume of a signal received via the output of the music system thereby effecting a coincident visual and audio spectacle.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
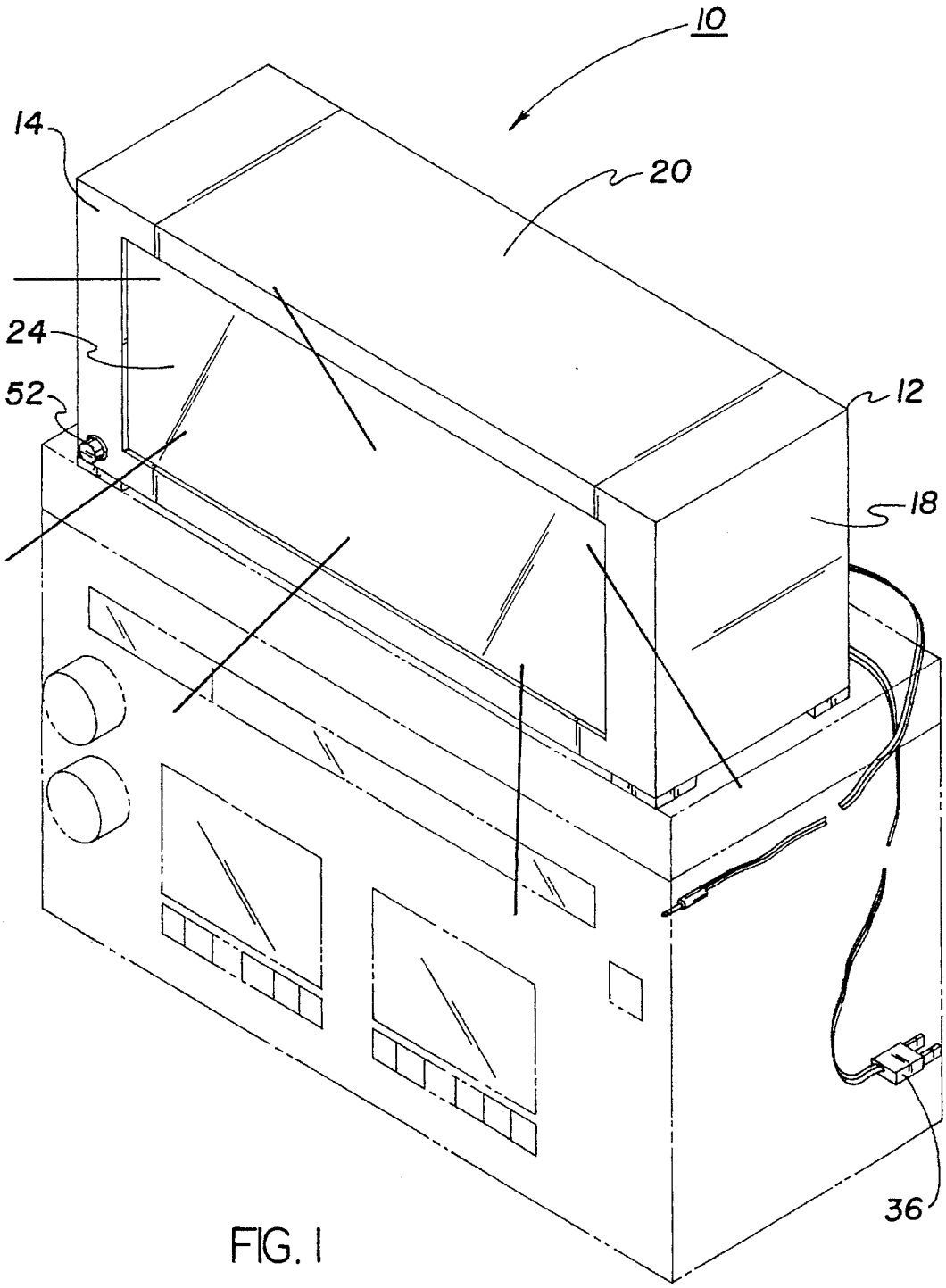
FIG. 1 is a perspective illustration of the preferred embodiment of the laser emitting visual device for a music system constructed in accordance with the principles of the present invention.
Figure 2:
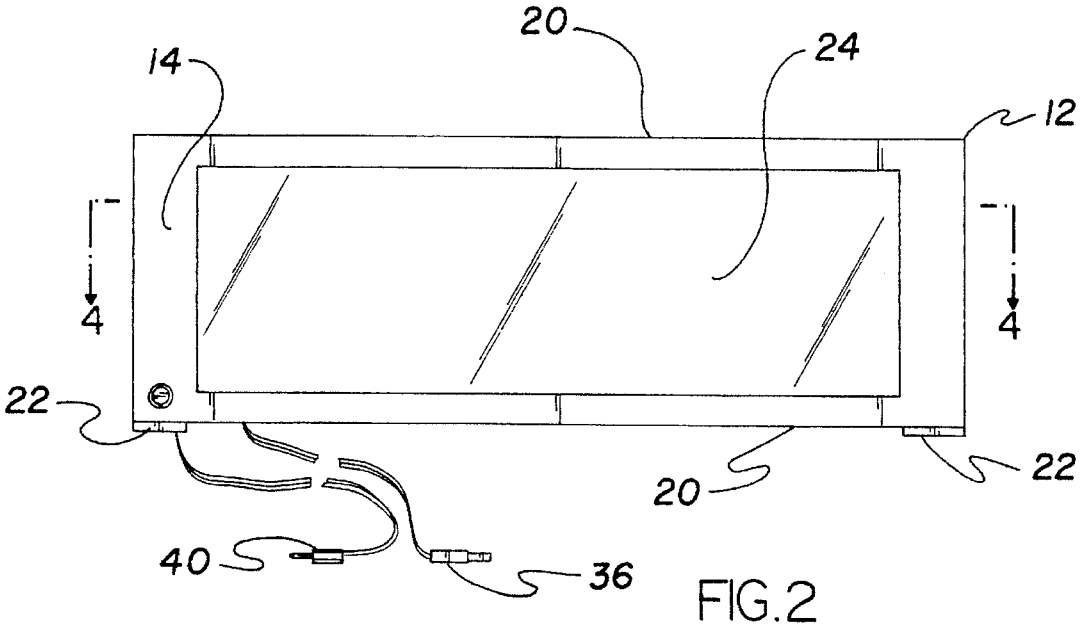
FIG. 2 is a plan view showing the front face of the laser emitting visual device.
Figure 3:
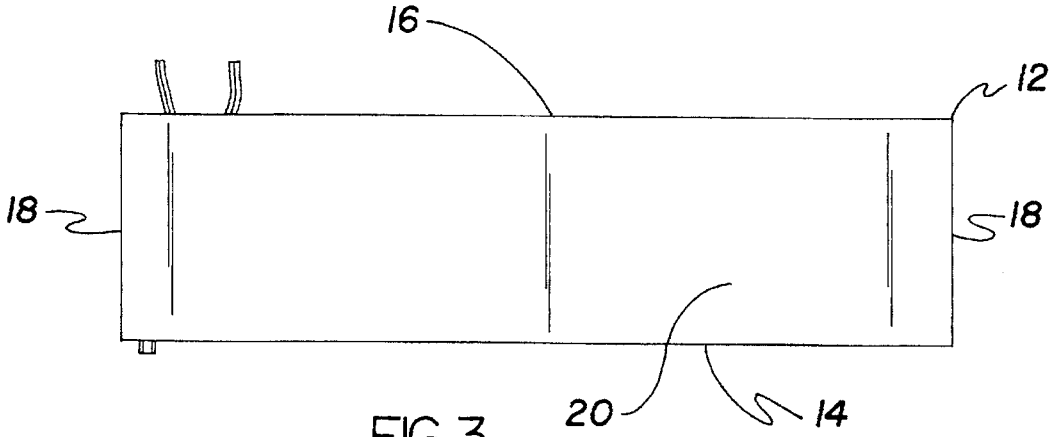
FIG. 3 is a plan view depicting the top face of the present invention.
Figure 4:
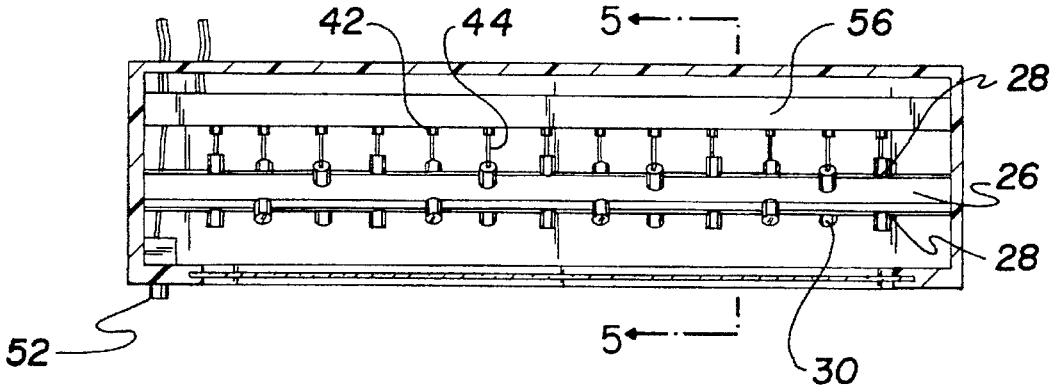
FIG. 4 is a cross-sectional top view depicting the laser mount, lasers, and interior of the housing.
Figure 5:
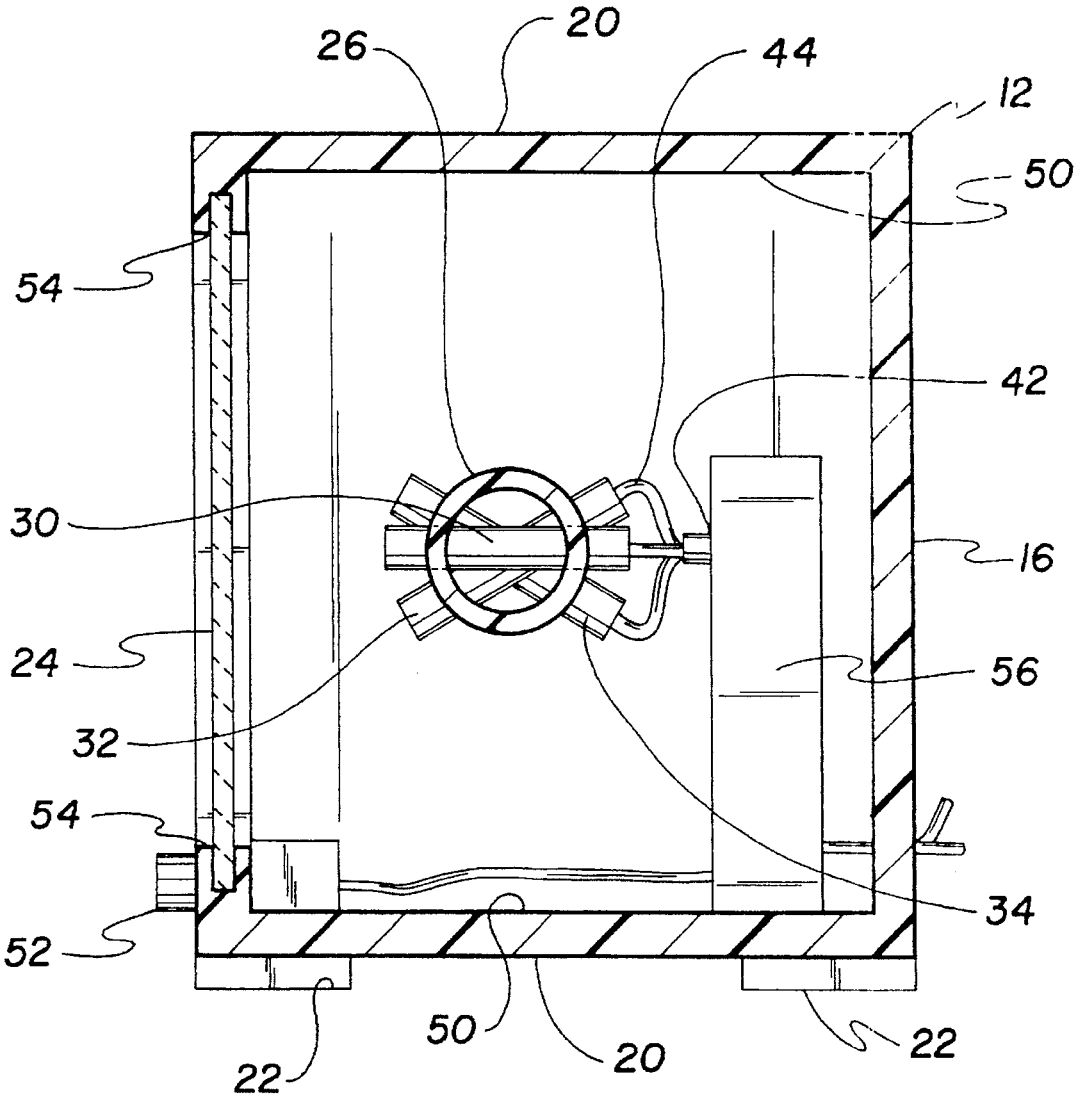
FIG. 5 is a cross-sectional side view also depicting the laser mount, lasers, and interior of the housing.
Figure 6:
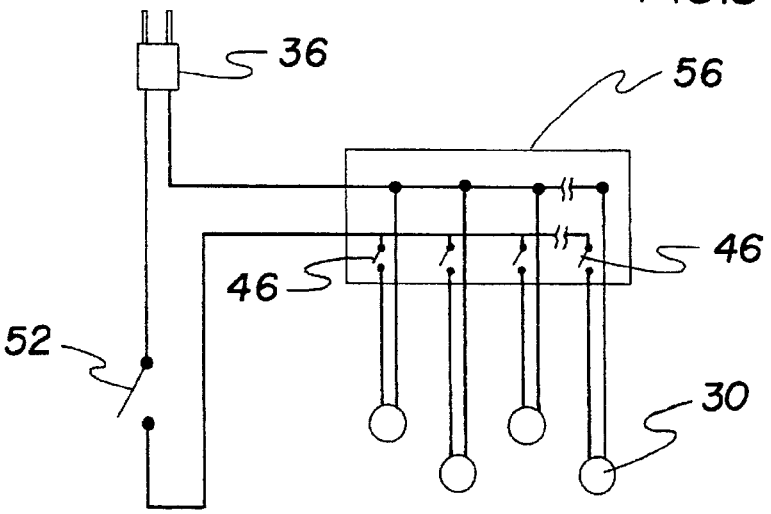
FIG. 6 is a schematic diagram depicting the circuitry employed by the present invention.

With reference now to the drawings, and in particular to FIG. 1 thereof, the preferred embodiment of the new and improved laser emitting visual device for a music system embodying the principles and concepts of the present invention and generally designated by the reference numeral 10 will be described.

The present invention, the new and improved laser emitting visual device for a music system is a system 10 comprised of a plurality of components. In their broadest context, the components include a housing, lasers, and control module. Each of the individual components is specifically configured and correlated one with respect to the other so as to attain the desired objectives.

More specifically, the system 10 of the present invention includes a rectangular housing 12 with a hollow interior defined by a horizontal planar top and bottom wall 20 and a periphery formed therebetween consisting of a front wall 14, rear wall 16 and pair of side walls 18. The exterior surfaces of the walls can be decorated with a variety of aesthetically pleasing designs. The housing is positionable on top of a typical music system. Four buffer pads 22 are located on each of the corners of the exterior surface of the lower wall to preclude damage and movement of the housing. Finally, a tinted transparent window 24 is inset within a channel 54 lining a rectangular opening in the front wall. The transparent window constitutes nearly the entire front wall.

A hollow tubular laser mount 26 is centrally coupled between the interior faces of the opposed side walls. The laser mount comprises a plurality of diametrically opposed apertures 28. The apertures form a plurality of angles less than 60 degrees with respect to the horizontal.

A plurality of small multi-color cylindrical lasers 30 are infixed within the apertures of the laser mount and extend radially outward therefrom. The lasers comprise a laser emitting end 32 and power receiving end 34 with the laser emitting end facing in the general direction of the transparent window. The lasers are adapted to emit a specific colored high intensity light beam when actuated via the power receiving end.

A rectangular elongated control module 56 is situated in the rear of the housing behind the lasers and laser mount. The control module is coupled to an alternating current source via a typical two-prong plug 36, output of a music system via a typical stereo jack 40, and each of the power receiving ends of the lasers. The control module includes a plurality of apertures 42 positioned directly behind each of the power receiving ends of the lasers providing a conduit for passage of connector lines 44. A plurality of switches 46 are coupled between the current source and each power receiving end of the lasers. Each switch has an open orientation for withholding current from the particular laser and a closed orientation for allowing current to flow thereto. The control module further comprises circuitry constructed to actuate different switches depending on the frequency and volume of a signal received via the output of the music system. Such circuitry is well known in the art and readily found in many applications.

Further included is a plurality of mirrors 50 lining the interior surfaces of the top and bottom walls and periphery of the housing. Such mirrors are adapted to enhance the visual effect of the laser by reflecting stray light toward the transparent window.

A single pole single throw pushbutton actuator switch 52 is positioned on the front face of the housing and coupled to the control module. The actuator switch has an open orientation for withholding current from the control module and closed orientation for allowing current to flow thereto. Such current thus actuates the laser emitting visual device.

In a second embodiment, the control circuitry is further adapted to automatically activate the lasers randomly with the absence of incoming signals from the music system. In addition, a fine tuner can be included to adjust the overall thresholds of volume and frequency required to activate the lasers hence effecting a more versatile device.

Operation and use of the laser emitting visual device for a music system is facilitated by the amalgamation of the components discussed hereinabove. Initially, the device is connected to both an alternating current source such as a conventional power receptacle and output of a music system such as a speaker or auxiliary output. Upon actuation of the device and music system, the different lasers emit high intensity light beams of a variety of colors through the transparent window effecting a home laser light spectacle. Different lasers are activated upon the receipt of corresponding frequencies and volumes emitted by the music system. For example, the lower frequencies of a bass instrument, approximately 60–150 MHZ, will activate a certain combination of lasers when a certain threshold within the frequency range is surpassed. The same can be said of mid-range instruments, approximately 400 MHZ–1 KHZ, and high-range instruments, approximately 6–15 KMHZ. Many further combinations of lasers can be selected to respond to an endless variety of frequency ranges effecting an impressive visual display.

The present invention allows receipt of signals from nearly any medium of audio playback such as records, cassettes, and compact discs. Also, it provides a direct connection with the music system via a speaker or auxiliary output ensuring an uninterrupted coincident audio and visual display.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved laser emitting visual device for a music system comprising, in combination:

a rectangular housing including a horizontal planar top and bottom wall and a periphery formed therebetween consisting of a front wall, rear wall and pair of side walls thereby defining a a hollow interior, the housing further including a tinted transparent window integrated within the front wall;

a hollow tubular laser mount centrally coupled between the interior faces of the opposed side walls comprising a plurality of diametrically opposed apertures, the apertures forming a plurality of angles less than 60 degrees with respect to the horizontal;

a plurality of multi-color cylindrical lasers infixed within the apertures and comprising a laser emitting end and power receiving end with the laser emitting end facing in the general direction of the transparent window, the lasers adapted to emit a specific colored high intensity light beam when actuated via the power receiving end;

a control module situated in the rear of the housing coupled to an alternating current source, output of a music system, and each of the power receiving ends of the lasers; the control module comprising a plurality of switches coupled between the current source and each power receiving end of the lasers, each switch having an open orientation for withholding current from the particular laser and a closed orientation for allowing current to flow thereto; and control circuitry adapted to actuate different switches depending on the frequency and volume of a signal received via the output of the music system;

a plurality of mirrors lining the interior surfaces of the top and bottom walls and periphery of the housing adapted to enhance the visual effect of the lasers; and an actuator switch positioned on the front face of the housing and coupled to the control module, the actuator switch having an open orientation for withholding current from the control module and closed orientation for allowing current to flow thereto thereby actuating the laser emitting visual device hence activating different lasers upon receipt of various signals from the output of the music system hence creating a coincident audio and visual effect.

2. A laser emitting visual device for a music system comprising:

a housing with a hollow interior and transparent window;

a hollow tubular laser mount centrally coupled between interior faces of opposed side walls of the housing comprising a plurality of diametrically opposed apertures, the apertures forming a plurality of angles less than 60 degrees with respect to the horizontal;

a plurality of multi-color cylindrical lasers infixed within the apertures and comprising a laser emitting end and power receiving end with the laser emitting end facing in the general direction of the transparent window, the lasers adapted to emit a specific colored high intensity light beam when actuated via the power receiving end; and a control means situated within the housing and coupled to a current source, an output of a music system, and each of the lasers and adapted to actuate different lasers depending on the characterization of a signal received via the output of the music system.

3. The laser emitting visual device for a music system as set forth in claim 2 and further including:

an actuator switch coupled to the control module and adapted to allow the actuation of the laser emitting visual device hence creating a coincident audio and visual effect.

4. The laser emitting visual device for a music system as set forth in claim 2 wherein the lasers are multi-colored.

5. The laser emitting visual device for a music system as set forth in claim 2 and further including:

a plurality of mirrors lining the interior surfaces of the housing adapted to enhance the visual effect of the lasers.

* * * * *